US006527561B1

(12) United States Patent
Glauser

(10) Patent No.: US 6,527,561 B1
(45) Date of Patent: Mar. 4, 2003

(54) METHOD FOR PRODUCING AN ELECTRIC CONNECTOR AND A CONNECTOR PRODUCED ACCORDING TO THIS METHOD

(75) Inventor: Peter Glauser, Schweizersholz (CH)

(73) Assignee: Huber + Suhner AG, Herisau (CH)

( * ) Notice: Subject to any disclaimer, the term of this patent is extended or adjusted under 35 U.S.C. 154(b) by 0 days.

(21) Appl. No.: 09/830,463

(22) PCT Filed: Oct. 25, 1999

(86) PCT No.: PCT/CH99/00502

§ 371 (c)(1),
(2), (4) Date: Apr. 27, 2001

(87) PCT Pub. No.: WO00/25391

PCT Pub. Date: May 4, 2000

(30) Foreign Application Priority Data

Oct. 27, 1998 (CH) ..... 2174/98

(51) Int. Cl.[7] ..... H01R 9/09
(52) U.S. Cl. ..... 439/63; 29/828
(58) Field of Search ..... 439/63, 581; 29/828, 29/837, 842, 874, 882

(56) References Cited

U.S. PATENT DOCUMENTS

| | | | | | |
|---|---|---|---|---|---|
| 4,645,288 | A | * | 2/1987 | Stursa | 439/581 |
| 4,964,805 | A | * | 10/1990 | Gabany | 439/434 |
| 5,823,790 | A | * | 10/1998 | Magnuson | 333/260 |
| 5,961,349 | A | * | 10/1999 | Paagman | 439/607 |
| 6,030,231 | A | * | 2/2000 | Sarkiniemi | 439/101 |
| 6,079,986 | A | * | 6/2000 | Beshears | 439/581 |
| 6,113,397 | A | * | 9/2000 | Myers | 439/581 |

FOREIGN PATENT DOCUMENTS

| | | | | | |
|---|---|---|---|---|---|
| GB | 2272800 | A | * | 5/1994 | 439/63 |

* cited by examiner

*Primary Examiner*—Lynn D. Feild
*Assistant Examiner*—Phuong KT Dinh
(74) *Attorney, Agent, or Firm*—Sughrue Mion, PLLC

(57) ABSTRACT

A connector (6, 7, 18, 23) has at least one free-standing pin (8 to 11; 19 to 22; 24, 25), which can be connected to a conductor of a printed circuit board (28). For producing the connector, a profiled, prism or rod-shaped starting body (30) is, on one end thereof, machined by turning around an axis (A) such that at least one pin is formed from an edge or profiling of the starting body. The method is significantly more economical than prior art milling methods and results in the production of especially stabile pins in the case of an extruded starting body.

6 Claims, 2 Drawing Sheets

METHOD FOR PRODUCING AN ELECTRIC CONNECTOR AND A CONNECTOR PRODUCED ACCORDING TO THIS METHOD

FIELD OF THE INVENTION

The invention concerns a method for producing an electrical connector according to the precharacterizing clause of claim 1. In addition, the invention concerns a connector produced according to this method.

Such connectors are known in high-frequency engineering under the designation "print connectors." In high-frequency engineering, the electrical and mechanical quality of the connection is especially important. In order to avoid undesired attenuation and radiation effects at the connection point, high requirements must be placed on the contact quality of inner as well as outer conductors and on the shielding properties of the connector and circuit board pairing. In addition, a portable application of associated devices requires a high mechanical stability of the connection. Conventionally, a high-frequency connection is achieved at circuit boards in that the inner conductor and the outer conductor of the coaxial connector are bonded to corresponding conductors on the circuit board. Often, the contacts are soldered to the circuit board or are plugged directly into the circuit board.

BACKGROUND OF THE INVENTION

The type of the bonding of the print connector to the circuit board can be configured in various manners. Often print connectors are assembled on the circuit board in the known SMD technology and soldered; this takes place primarily using the reflow soldering procedure especially suited for such purpose. In another often used type of bonding, the connector is inserted into holes which are specially reserved in the circuit board for them and which are in most cases throughplated, i.e., coated with metal, and on the underside of the plate often is soldered in the so-called flow-soldering bath soldering method which is especially suited for this purpose. In another method, the coaxial connectors with the inner conductor and the outer conductor are inserted, directly and gas-tight, into metallically conductive holes in the circuit board which are adapted specifically for that purpose via specially shaped, innately mildly springy grooved-pin-like feet. In still another frequently used method, the connector is embedded and soldered lying on the edge in a recess set at an edge of the circuit board, wherein not a vertical axis of the conductor is selected as in the method described previously, but rather an axis parallel to the plane of the circuit board is selected.

SUMMARY OF THE INVENTION

The production of such connectors or print connectors in the past took place in a milling process with comparably expensive production equipment. The geometric features of the connectors differ depending on the type of contact with the circuit board. The milling procedure used in the past was comparably involved and time intensive. It should be noted that such connectors are produced in high numbers. In addition, handling is made more difficult as a result of the small dimensions of such connectors. Disclosed in GB 2 272 800 A is a print connector in which exposed pins are produced from an initial body through turning and through milling. Thus a milling machine is required in this case for producing [the connectors]. WO 97/45899 discloses a coaxial connector in which the connector pins are produced from the four corners of a four-cornered billet through turning and milling.

The invention is based on the task of creating a method of the type mentioned which makes possible a significantly more cost-effective production of connectors of the type mentioned.

The task is achieved in a method in that a profiled, prism or rope-shaped initial body at least at its one end is processed by turning such that from one edge or profile of the initial body, at least one pin is exposed. Essential for the method is the above-mentioned initial body from which a connector can be produced through turning more cost-effectively and more simply than previously. A connector of the type mentioned can essentially be produced solely through turning of the initial body mentioned. The processing machinery necessary for this purpose is essentially less expensive than the milling equipment necessary in the past. The above-mentioned initial body can in particular be produced through drawing, extrusion, or molding. A drawn initial body has proven to be especially advantageous, with a significant increase in strength of the exposed pin, the so-called print foot, being possible. The contacts are accordingly much more stable. Deformations and warping of these print feet can be avoided with this production and handling process.

A further technologically interesting possibility is provided through an additional, for example, plastic deformation or a cutting process on the pins or print feet which can then be inserted directly and without soldering into a corresponding circuit board and thus provide an electrical and mechanically reliable as well as gas-tight contact. Additional advantages of the method according to the invention are the higher production precision and the higher degree of reproducibility of the relevant process values.

Additional advantageous features are contained in the dependent patent claims, the following description, and the drawing. Exemplary embodiments of the invention are explained in greater detail below with the aid of the drawings.

BRIEF DESCRIPTION OF THE DRAWINGS

FIG. 1 shows an initial body 30 which preferably is produced of metal and which has four ribs 2–5 which protrude radially and run parallel to a longitudinal axis A. Initial body 30 is preferably composed of material which is drawn in the direction of axis A. Initial body 30 is thus formed in a profiled manner. However, it can also be prism-shaped or otherwise shaped such as rope-shaped. Besides drawing, it can also be produced through extrusion or molding. FIG. 2 shows a cross section through initial material 30. As shown by FIG. 2, initial material 30 comprises a basic body 1 and four uniformly protruding ribs 2, 3, 4, and 5.

Figure 1:
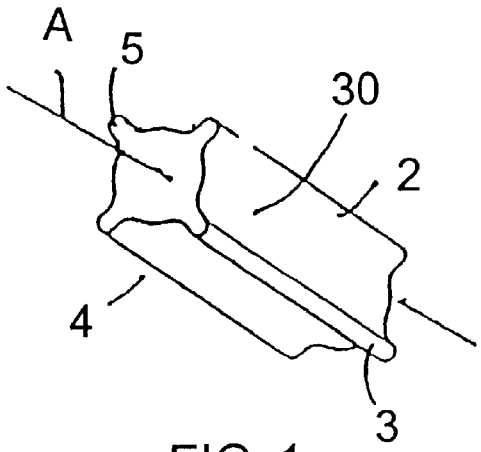
FIG. 1 shows a three-dimensional view of an initial body.
Figure 2:
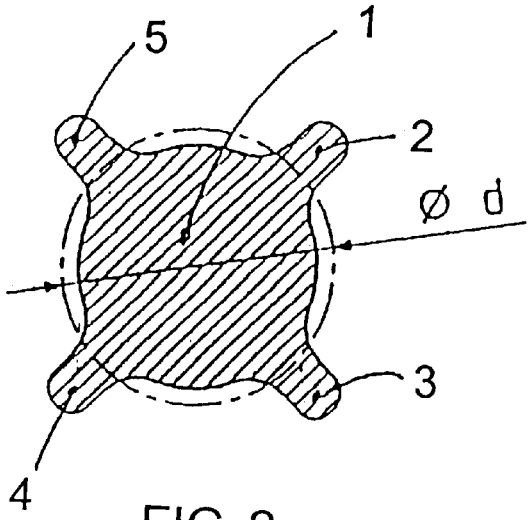
FIG. 2 shows a cross section through the initial body according to FIG. 1.
Figure 3:
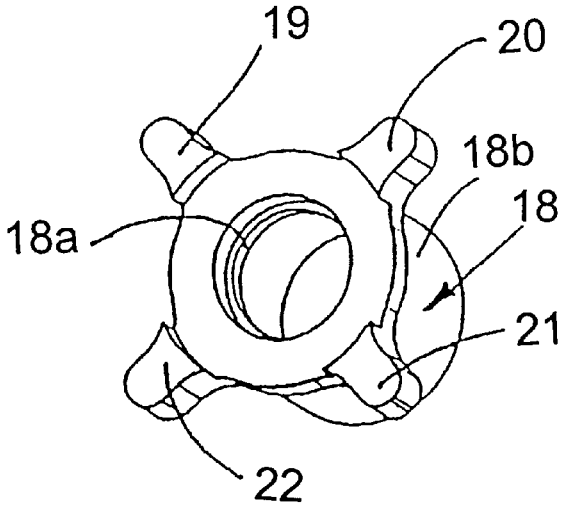
FIG. 3 shows a three-dimensional view of a connector according to the invention for vertical mounting on a circuit board, with this connector being especially suited for reflow soldering.

Initial body 30 is processed through turning around axis A. In this manner, as suggested in FIG. 2, the cylindrical zone 1 is partially removed by turning with the diameter d. Ribs 2 through 5 in this process are exposed and form print feet 19 through 22 in the connector 18 shown in FIG. 3. The through hole 18*a* shown in FIG. 3 and the jacket surface 18*b* are preferably also produced through turning around axis A. Thus connector 18 essentially can be produced solely through turning of initial body 30.

Connector 18 preferably is a coaxial connector outer conductor in SMD technology. It is arranged vertically on a circuit board and is bonded through reflow soldering. Through the configuration of the cross section of initial body 30, various forms of print feet 19 through 22 can be produced. Initial body 30 can fundamentally also be prism-shaped, for example quadratic in cross section. The corners of the initial body then form the correspondingly shaped print feet. The forming of the print feet can also be changed through changing the diameter d as well as through the depth of the hollowing out by turning.

Figure 4:
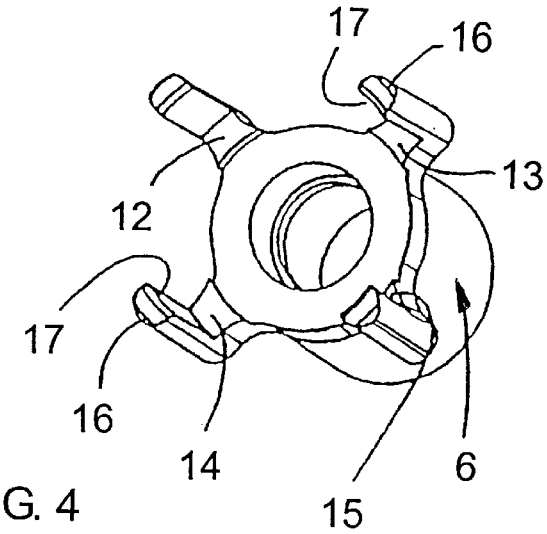
FIGS. 4 and 5 show variants of the connector according to the invention which are suitable for vertical mounting on a circuit board and are especially suited to flow-soldering bath soldering.

FIG. 4 shows a connector 6 which has four shoulders 12 through 15 as well as continuously tapered inlets 16 and 17. Shoulders 12 through 15 and inlets 16 and 17 are likewise produced through turning. Connector 6 is provided for vertical mounting on a circuit board. For bonding, flow-soldering bath soldering, which is known as such, is especially suitable for this.

Figure 5:
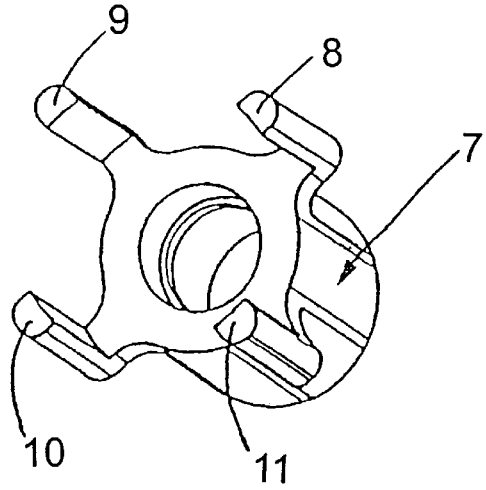

FIG. 5 shows a further variant of a connector 7 which has four print feet 8 through 11.

Figure 6:
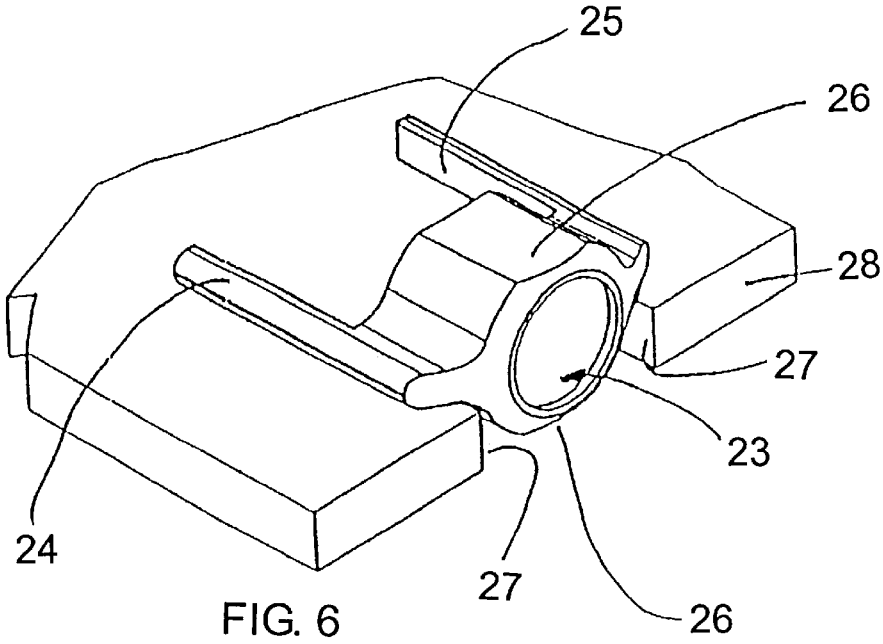
FIG. 6 shows a connector according to the invention which is placed horizontally on a circuit board which is shown only in part here.

FIG. 6 shows a connector 23 which is inserted horizontally in a rectangular groove 27 of a circuit board 28. Connector 23 is a coaxial connector housing. It has only two print feet 24 and 25. These print feet 24 and 25 form outer conductor contacts and are produced solely through turning. The initial body used for connector 23 has accordingly only two ribs, by way of example in FIG. 2, ribs 2 and 3. In addition, connector 23 has two parallel outer surfaces 26 which by way of example can be produced through milling. An embodiment is also conceivable in which the connector has only one foot for electrical contact. Finally, embodiments with more than four feet or pins are also conceivable.

What is claimed is:

1. A method for producing an electrical connector (6, 7, 18, 23) which has at least one exposed pin (8 through 11; 19 through 22; 24, 25), which can be bonded to a circuit board (28), with a profiled, prism- or rope-shaped initial body (30) comprising:

machining one end of at least one pin by turning around a longitudinal axis (A) of the initial body (30) such that the at least one pin is exposed from a corner of the initial body (30), wherein the initial body (30) has at least one rib (2 through 5) on its circumference extending in the longitudinal direction and the at least one pin (19 through 22; 8 through 11; 24, 25) is exposed out of said rib.

2. The method according to claim 1 characterized in that a cylindrical zone (1) is hollowed out of the initial body (30) through turning, with the axis of rotation of this zone (1) coinciding with the longitudinal axis (A) of the initial body (30).

3. The method according to claim 1 characterized in that in one work process several essentially symmetrically arranged pins (8 through 11; 19 through 22; 24, 25) are formed through hollowing out by turning a radially symmetrical and cylindrical zone (1) at one end of the initial body (30).

4. The method according to claim 1 characterized in that the initial body (3) has four radially protruding ribs (2 through 5) formed at a cylindrical zone (1) and that during turning, a section of the cylindrical zone (1) is removed.

5. The method according to claim 1 characterized in that the connector is a coaxial connector housing.

6. The method according to claim 1 characterized in that the initial body (3) is produced from a drawn material.

* * * * *